US011772145B2

(12) United States Patent
Lazo et al.

(10) Patent No.: US 11,772,145 B2
(45) Date of Patent: Oct. 3, 2023

(54) HIGH EFFICIENCY STRIPPER NOZZLE

(71) Applicant: Nortek, S.A., Saragossa (ES)

(72) Inventors: Jose Rafael Lazo, Spencer, MA (US); John Paul Gasparik, Webster, MA (US)

(73) Assignee: Nortek, S.A., Saragossa (ES)

( * ) Notice: Subject to any disclaimer, the term of this patent is extended or adjusted under 35 U.S.C. 154(b) by 401 days.

(21) Appl. No.: 15/959,313

(22) Filed: Apr. 23, 2018

(65) Prior Publication Data

US 2019/0262882 A1 Aug. 29, 2019

(30) Foreign Application Priority Data

Feb. 27, 2018 (ES) ..... 201830186

(51) Int. Cl.

| | |
|---|---|
| ***B21C 43/02*** | (2006.01) |
| ***B21C 35/06*** | (2006.01) |
| ***B21B 45/02*** | (2006.01) |
| ***B05B 1/28*** | (2006.01) |
| ***B08B 5/02*** | (2006.01) |

(52) U.S. Cl.

CPC ..... *B21C 43/02* (2013.01); *B21B 45/0224* (2013.01); *B21B 45/0257* (2013.01); *B21C 35/06* (2013.01); *B05B 1/28* (2013.01); *B08B 5/023* (2013.01)

(58) Field of Classification Search

CPC ..... B05B 7/0441; B05B 7/0491; B05B 7/06; B05B 7/062; B05B 7/068; B21C 3/14; B21C 9/00; B21C 9/005; B21C 9/02; B21C 23/32; B21B 45/0233; B21B 2027/103; B65G 53/42

USPC ..... 239/425, 427, 427.5, 429; 406/194

See application file for complete search history.

(56) References Cited

U.S. PATENT DOCUMENTS

| | | | | |
|---|---|---|---|---|
| 2,203,751 | A * | 6/1940 | Simons | B21C 3/14 72/45 |
| 2,252,365 | A * | 8/1941 | Fisher | B21C 3/14 72/463 |
| 2,606,650 | A * | 8/1952 | Evans | B21C 9/00 72/46 |
| 3,080,962 | A * | 3/1963 | Fleischmann | B21C 9/00 72/42 |
| 3,677,049 | A * | 7/1972 | Cartwright | B21C 23/007 72/60 |
| 3,731,509 | A * | 5/1973 | Fuchs, Jr. | B21C 23/008 72/60 |
| 3,945,623 | A * | 3/1976 | Gaudilliere | B21B 45/0203 266/112 |

(Continued)

*Primary Examiner* — Adam J Eiseman
*Assistant Examiner* — Stephen Floyd London

(57) ABSTRACT

A high efficiency stripper nozzle, with a through hole configured to be connected to the through hole of another nozzle, guide, or nozzle, which comprises several radial channels that pass through the nozzle from the perimeter zone to the hole at its entrance zone. The nozzle may be divided into several pieces which can be connected together in a removable way and replaceable, which may form the radial channels between them with different sections and angles with respect to the axis of the hole. The radial channels may contact externally with an opening located on one of the surfaces of the nozzle or on one of the surfaces of the nozzle to which the nozzle is connected.

12 Claims, 1 Drawing Sheet

(56) References Cited

U.S. PATENT DOCUMENTS 4,312,094 A * 1/1982 Daverio ..... C21D 9/5732 15/302
4,798,526 A * 1/1989 Briggs ..... B29C 48/30 425/113
4,952,132 A * 8/1990 Lundquist ..... B29B 13/10 210/390
5,118,226 A * 6/1992 Horii ..... B65G 53/58 406/92
5,125,979 A * 6/1992 Swain ..... C01B 32/55 425/7
5,329,779 A * 7/1994 Lozano ..... B21B 45/0224 62/374
5,511,403 A * 4/1996 Krymsky ..... B21C 9/005 508/165
5,587,076 A * 12/1996 Herzog ..... B29C 48/694 210/461
5,690,972 A * 11/1997 Planeta ..... B29C 48/30 425/133.1
5,780,066 A * 7/1998 Guillemette ..... B29C 48/30 425/113
5,853,770 A * 12/1998 Guillemette ..... B29C 48/30 425/113
5,980,226 A * 11/1999 Guillemette ..... B29C 48/30 425/113
6,200,071 B1 * 3/2001 Karasawa ..... B65G 53/521 406/92
6,427,876 B1 * 8/2002 Fuchs ..... B05B 11/00444 222/321.2
6,663,325 B1 * 12/2003 Kai ..... H01L 21/67721 406/84
6,997,405 B2 * 2/2006 Haruch ..... B05B 7/10 239/690
7,018,197 B2 * 3/2006 Babin ..... B05B 1/24 264/328.15
7,311,474 B1 * 12/2007 Ogasahara ..... B65G 53/14 406/146
8,821,775 B2 * 9/2014 Roberts ..... B29D 23/00 264/173.16
2001/0008061 A1 * 7/2001 Arishiro ..... H05K 13/021 53/54
2005/0074303 A1 * 4/2005 Morohashi ..... B65G 53/14 406/194
2005/0103074 A1 * 5/2005 Kim ..... B21C 9/005 72/43
2011/0162427 A1 * 7/2011 Nakata ..... B21B 45/0233 72/201
2012/0107060 A1 * 5/2012 Leininger ..... F23K 3/02 406/92
2013/0340221 A1 * 12/2013 Nobile ..... B24D 9/08 29/81.08

* cited by examiner

HIGH EFFICIENCY STRIPPER NOZZLE

RELATED APPLICATION

This application claims the benefit of priority of Spanish Patent Application No. 201830186 filed Feb. 27, 2018, the contents of which are incorporated herein by reference in their entirety.

FIELD AND BACKGROUND OF THE INVENTION

The purpose of the present application is to register a stripper nozzle that incorporates significant advantages over those used to date, particularly convenient for refrigeration and/or lubrication processes during the production of metal products with continuous longitudinal shapes, such as wire, rods, or bars.

More specifically, the invention proposes a stripper nozzle with radial channels which, due to their specific geometry, restrain the circulation of the coolant and/or lubricant that accompanies the metal product being produced, preventing leaks and excessive flow of said fluid.

Cooling and/or lubrication systems for the processing of metal in continuous longitudinal shapes are known. The processing requires the use of a fluid at a certain amount of pressure in order to cool, wax, or lubricate the metal product.

One of the main problems in existing systems is the containment of the coolant/lubricant fluid. Due to the nature of the process, it is difficult to ensure that the pressurized fluid will stay within the limits of the system. Any loss of fluid becomes a financial loss and an additional maintenance expense, because it could affect the functioning of other components on the production line and create demand for additional repairs of other mechanical or electrical equipment. It may also become a potential safety, environmental, and operational risk, or a limiting factor for the measurement of the efficiency of the production process.

At the same time, faster speeds and higher production volumes in installations increase the cooling/lubrication requirements, and therefore increase the possibility of loss and lack of control.

Existing devices for reducing the amount of fluid carried by the metal product and later spilling, consist of stripper nozzles located at the entrance of nozzles through which the product runs, which inject water or compressed air, or of gaps to allow the water to fall into a container, but given the current operating speeds in modern metal processing plants, these devices are inefficient. Therefore, there is still a need for a device that is able to solve the existing problems.

SUMMARY OF THE INVENTION

The present high-efficiency stripper nozzle is a new development in the field of application that resolves the problems mentioned above. It was developed in order to provide a way to avoid leaks and excessive flow of coolant and/or lubricant used during the production of metal products with continuous longitudinal shapes, especially at present and future processing speeds.

The stripper nozzle of the invention consists of at least one body with through hole, configured to connect to the through hole of another stripper nozzle, guide or nozzle, and that may be designed with different sizes to be adapted to different metal products of the process, with said hole optionally having a cone-shaped entrance. The stripper nozzle in turn comprises a fluid connection from the perimeter zone to the entrance of the hole, formed by several internal sections in the form of channels that pass through the stripper nozzle radially. These channels may reach the conical wall of the entrance, in case the stripper nozzle is equipped with a conical one. Each one of said radial channels may have a different radial angle, or the channel itself may even have multiple angled sections, which may be at an angle of between 5° and 90° with respect to the axis of the hole.

For the fluid connection of the channels to the outside, the stripper nozzle may comprise one or more perimeter slots or openings located on its longitudinal surfaces or, in case the hosting guide or nozzle has at least one opening, a connection channel to said opening.

Preferably, the stripper nozzle may be divided into a series of pieces that share said through hole, being able to be connected together in a removable and replaceable way. The internal walls that separate the pieces may have a conical shape, while each separation may be defined by a different conical angle, with said angle possibly being between 5° and 90°. The internal walls comprise a series of gaps or spaces between them that form the aforementioned radial channels. Consequently, the user may configure different sets of stripper nozzles with channels with different volumes and outlet angles.

In one possible embodiment, the series of pieces may comprise a piece that houses one or more pieces of the stripper nozzle inside it, or in another possible embodiment, it may consists of pieces that can be connected in series only in the lateral direction, without a piece that houses them on the exterior. In both embodiments, the stripper nozzle may comprise at least two pieces that are symmetrical with respect to one of the planes that coincide with the axis of the hole, such that the user can access and inspect the surface of the hole without difficulty. Likewise, different sets of pieces may exist that have different exterior geometries to adapt to the connection to other stripper nozzles, guides, or nozzles with different dimensions and shapes. To connect to the different types of existing stripper nozzles, stripper nozzle sets with the corresponding adequate means of attachment are also considered.

Due to the fact that the geometry of the hole and the channels between the pieces is adjustable and may vary from piece to piece, the user can define the proper configuration based on the different parameters of the cooling/lubrication process, such as the type of fluid, the size of the metal product, the process speed, etc.

In conditions of use, the stripper nozzle is positioned on the path of the metal product, either at the entrance or outlet of the nozzle, such that the product runs through its hole. The orientation of the stripper nozzle depends on the direction of flow of the coolant/lubricant, so the entrance to the hole of the stripper nozzle is always positioned facing said flow, regardless of the direction of movement of the metal product.

There are two possible methods for using the stripper nozzle. In the first method, the stripper nozzle is supplied with a pressurized fluid, either a liquid or gas, through the perimeter opening. Thanks to the multiple radial channels that pass through the stripper nozzle, the fluid reaches the area of the entrance of the hole. After the proper selection by the user of the number of channels and the angle of each one, the pressurized fluid optimally emerges partially facing the coolant/lubricant fluid, generating a countercurrent flow at the stripper nozzle entrance that prevents the coolant/lubricant fluid from continue moving forward through the stripper nozzle.

In the second method, the stripper nozzle is not supplied with a fluid. In this case, the coolant/lubricant fluid that arrives around the metal product itself enters through at least one of the radial sections, and depending on the geometric arrangement of the channels, emerges towards the perimeter opening and/or towards the entrance of the hole itself through the rest of the channels. Consequently, the coolant/lubricant fluid may be collected through the perimeter opening and/or may generate a countercurrent flow in itself that stops it in the entrance of the hole.

Therefore, when the high-efficiency stripper nozzle is supplied with a fluid through the perimeter slot, the operation produces a countercurrent effect against the coolant/lubricant fluid. When the high-efficiency stripper nozzle is not supplied with any fluid, it promotes the recirculation of the coolant/lubricant fluid itself, creating volumes of vacuum and countercurrent flows that likewise stop the continuous flow of said fluid through the stripper nozzle. In any case, in some specific cases, it is acceptable to allow a small amount of fluid to pass through the stripper nozzle and create a mist effect, which is suitable for specific cooling/lubrication processes.

Lastly, in either of the two previous embodiments, the fluid retained in the stripper nozzle entrance can be easily collected in a container, without generating waste, and regardless of the processing parameters of the metal.

DESCRIPTION OF SPECIFIC EMBODIMENTS OF THE INVENTION

The aforementioned figures, according to the adopted numbering, show a preferred embodiment of the invention, which comprises the parts and elements that are indicated and described in detail below.

Figure 1:
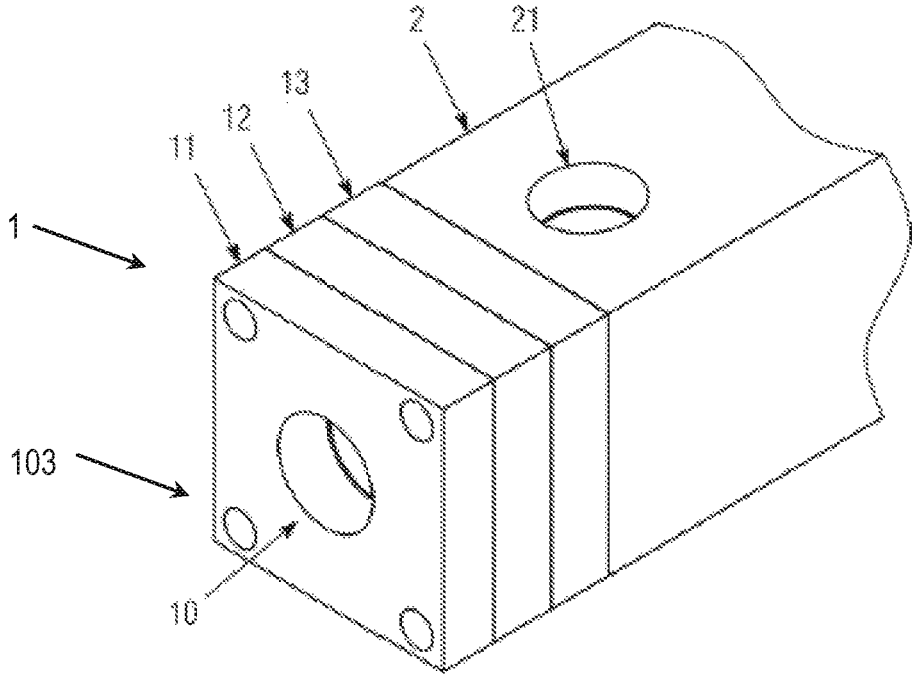
FIG. 1—Shows a perspective view of the present stripper nozzle installed on a nozzle.
Figure 2:
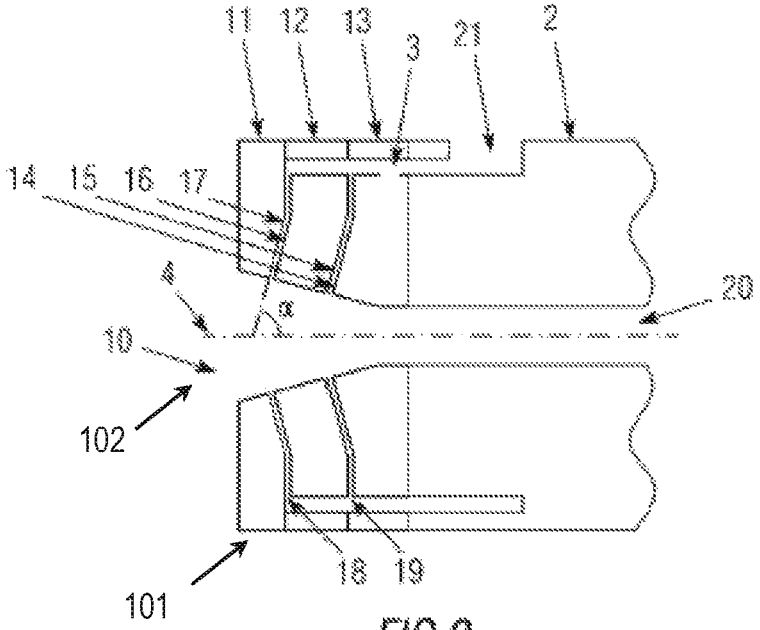
FIG. 2—Shows a cross-section view of the previous view through the vertical plane of symmetry.

As shown in FIG. 1, one possible embodiment of the present stripper nozzle (1) is divided into a set of three pieces (11, 12, 13), arranged in series and attached to a nozzle (2), whose through hole (20) is connected to the through hole (10) of the stripper nozzle (1), in this case with a cone-shaped entrance zone (102).

In this embodiment, the internal contact walls (14, 15, 16, 17) between the pieces (11, 12, 13) have an angled cross-section with respect to the axis (4) of the hole (10), with a conical angle ($\alpha$) of 15°. The walls comprise gaps such that between them, radial channels (18, 19) are formed, which emerge, on one hand, at the entrance zone (102) of the through hole (10), and on the other, are connected to the opening (21) located on one of the longitudinal faces of the nozzle (2) by means of a perimeter channel (3), which, in this case, the internal pieces (12, 13) share with the nozzle (2).

In this embodiment, as shown in FIG. 1, the means for attaching the stripper nozzle (1) to the nozzle (2) are made up of several holes(103) in the corners of the front face for threading screws (not shown in the figure).

The details, shapes, dimensions, and other accessory elements, as well as the materials used in the fabrication of the present stripper nozzle may be substituted as needed with others that are technically equivalent and that are not at variance with the essential nature of the invention or the scope defined by the claims included below.

What is claimed is:

1. A stripper nozzle (1), for production of an elongated metal product, made up of at least one body with a through hole (10) having a longitudinal axis (4) configured to be connected to a through hole (20) of another stripper nozzle, guide, or nozzle (2), wherein the stripper nozzle comprises a plurality of radial channels (18, 19) passing through the stripper nozzle (1) from a perimeter zone (101) of the stripper nozzle (1) to an entrance zone (102) of the through hole (10) of the stripper nozzle (1), being the 1 entrance zone (102) fluidly coupled to an atmosphere in an outside region of the stripper nozzle (1);

wherein the through hole (10) is adapted to lead along the longitudinal axis (4) a coolant/lubricant fluid flow and the elongated metal product having a continuous longitudinal shape having the coolant/lubricant fluid therearound;

wherein each of the plurality of radial channels (18, 19) has a point of entrance to the through hole (10) at angle ($\alpha$) of between 50 and less than 90° with respect to the longitudinal axis (4) of the through hole (10) such that a fluid guided through said plurality of radial channels (18, 19) generate a countercurrent flow against the coolant/lubricant fluid flow at the entrance zone (102), resulting in a collision between the countercurrent flow and the coolant/lubricant fluid flow in the entrance zone (102).

2. The stripper nozzle according to claim 1, wherein the stripper nozzle comprises a perimeter channel (3) that connects the plurality of radial channels (18, 19) to an opening located on one of a plurality of surface sides parallel to the longitudinal axis (4) of the through hole (10) of the stripper nozzle (1).

3. The stripper nozzle according to claim 1, wherein the stripper nozzle comprises a perimeter channel (3) that connects the plurality of radial channels (18, 19) to an opening (21) located on one of a plurality of surface sides of the another stripper nozzle (2).

4. The stripper nozzle according to claim 1, wherein the entrance zone (102) of the through hole (10) of the stripper nozzle (1) has a cone-shaped lumen.

5. The stripper nozzle according to claim 1, wherein the stripper nozzle is divided into different pieces (11, 12, 13) connected together in a removable and replaceable way.

6. The stripper nozzle according to claim 5, wherein the plurality of radial channels (18, 19) are formed by several gaps located between internal contact walls (14, 15, 16, 17) of the pieces (11, 12, 13).

7. The stripper nozzle according to claim 6, wherein the plurality of radial channels (18, 19) present different angles (a) with respect to the longitudinal axis (4) of the through hole (10) of the stripper nozzle (1).

8. The stripper nozzle according to claim 5, wherein one of the different pieces of the stripper nozzle (1) houses other ones of the different pieces of The stripper nozzle (1).

9. The stripper nozzle according to claim 2, wherein the stripper nozzle comprises at least two pieces that are symmetrical with respect to the longitudinal axis (4).

10. The stripper nozzle (1) according to claim 1, wherein the fluid led by the plurality of radial channels (18, 19) is pressurized externally to the stripper nozzle (1).

11. The stripper nozzle (1) according to claim 1, wherein the coolant/lubricant fluid flow enters through at least one radial channel of the plurality of radial channels (18, 19) and emerges towards the entrance zone (102) through one or more other radial channels of the plurality of radial channels (18, 19).

12. The stripper nozzle (1) according to claim 1, wherein the plurality of channels are situated on a tapered part of the nozzle.

* * * * *